United States Patent [19]

Heikel

[11] 4,180,449

[45] Dec. 25, 1979

[54] BONDED ASBESTOS DIAPHRAGMS AND MATS

[75] Inventor: Henrik R. Heikel, Midland, Mich.

[73] Assignee: The Dow Chemical Company, Midland, Mich.

[21] Appl. No.: 943,020

[22] Filed: Sep. 18, 1978

[51] Int. Cl.[2] ..... C25B 13/00; C25B 13/06; C25B 13/08

[52] U.S. Cl. ..... 204/296; 204/295; 427/372 R; 428/288

[58] Field of Search ..... 204/295, 296; 428/288, 428/289, 443; 427/372 R, 380

[56] References Cited

U.S. PATENT DOCUMENTS

| | | | |
|---|---|---|---|
| B 402,929 | 2/1976 | Foster | 428/289 |
| 2,710,268 | 6/1955 | Bump | 428/288 |
| 3,505,200 | 4/1970 | Grotheer | 204/295 |
| 3,723,264 | 3/1973 | Leduc et al. | 204/80 |
| 3,945,910 | 3/1976 | De Ceuster et al. | 204/296 |
| 3,980,613 | 9/1976 | Bachot et al. | 264/45.3 |
| 3,991,251 | 11/1976 | Foster et al. | 204/295 |
| 4,065,534 | 12/1977 | Rechlicz et al. | 204/296 |
| 4,093,533 | 6/1978 | Beaver et al. | 204/295 |
| 4,111,866 | 9/1978 | Torikai et al. | 204/296 |

FOREIGN PATENT DOCUMENTS 430880 11/1974 U.S.S.R. .

OTHER PUBLICATIONS

The Organic Chemistry of Titanium, by Raoul Feld and Peter L. Cowe, Washington Butterworths, (1965), p. 173.

M. S. Badollet, Asbestos, A Mineral of Unparalleled Properties, The Canadian Mining & Metallurgical Bulletin, Apr. 1951, pp. 238–246.

*Primary Examiner*—T. M. Tufariello

*Attorney, Agent, or Firm*—R. W. Selby

[57] ABSTRACT

Improved asbestos-containing diaphragms and mats are prepared by bonding the asbestos fibers to one another by pyrolyzing an organic titanate in situ.

30 Claims, No Drawings

BONDED ASBESTOS DIAPHRAGMS AND MATS

BACKGROUND OF THE INVENTION

Diaphragm cells have been used for many years for the electrolysis of brines and the formation of chlorine and caustic. These cells have an anolyte chamber separated from a catholyte chamber by a porous diaphragm which has customarily been made of fibrous asbestos that has been deposited upon a porous, metal cathode. Brine is fed into the anolyte chamber, where chlorine is produced, and the anolyte liquor then passes through the asbestos diaphragm into the catholyte chamber. Here caustic is produced and is later recovered from the cell effluent.

The service life of asbestos diaphragms is in the range of six months, as compared to an anode life of 3 to 4 years or more for the new metal anodes. Accordingly, the replacement of cell diaphragms has become now a principal factor in cell outage.

These problems have been attacked by replacement of asbestos with various plastics in the production of cell diaphragms; by reinforcing asbestos fibers with a variety of polymers (e.g. fluorocarbons, U.S. Pat. Nos. 3,944,477 and 3,694,281); and by treating asbestos fibers with inorganic coating agents, such as alkali metal ions (U.S. Pat. No. 3,402,929).

SUMMARY OF THE INVENTION

It has now been found that improved porous, fibrous, asbestos-containing diaphragms and mats can be made by impregnating the same with an organic titanate and then heating the diaphragm and mats to pyrolyze the organic titanate in situ. This treatment bonds the asbestos fibers to one another to produce more durable diaphragms and mats.

DETAILED DESCRIPTION

As noted above, it has been customary in the art to produce asbestos diaphragms for use in electrolytic cells, such as those employed in the production of halogen and caustic, by depositing asbestos fibers on the porous metal cathodes. This is usually done by first making an aqueous slurry containing asbestos and other additives, such as surfactants, and then drawing the slurry through an electrolyte-permeable cathode member to deposit asbestos thereon. This produces a fibrous, asbestos diaphragm which is permeable to the electrolyte.

As used herein the word "diaphragm" refers to a diaphragm for use in an electrolytic cell. The word "mat" is used to designate a member having one dimension substantially less than the other two, such as ceiling tile, filters, or backing for vinyl floor coverings. All percentages recited in this specification and claims are in percent by weight unless otherwise specifically designated.

In general, the present invention comprises the treatment of an asbestos-containing diaphragm with an organic titanate. The titanate is dissolved in a suitable solvent and the diaphragm then impregnated with this solution. Preferably such impregnation is carried out so as to thoroughly and uniformly wet the asbestos fibers with the solution. Excess solution is then removed by draining and drying. Exposure of the diaphragm to a hydrolyzing agent, such as water, in air or some other gas, hydrolyzes the organic titanate. The treated diaphragm is heated to pyrolyze the hydrolyzed titanate in situ, which effects bonding of the asbestos fibers to one another. Not only is a more durable diaphragm produced in this manner, but a major increase in stability of the diaphragm in acid solutions, particularly diaphragms made using chrysotile asbestos, unexpectedly occurs. This bonding of the asbestos fibers by the pyrolysis in situ of the organic titanate, and the unexpected results thereby achieved, occur in any fibrous, asbestos mat treated according to the present invention.

Turning now to a detailed discussion of the present invention, this invention is applicable to any porous, fibrous asbestos-containing diaphragm suitable for use in an electrolytic cell, especially cells used to produce chlorine and caustic. Chrysotile, or white asbestos, is the type of asbestos most widely used, either alone or in admixture with other types of asbestos. Another widely used asbestos is crocidolite, or blue asbestos, which is frequently used in conjunction with chrysotile. Still other types of asbestos, such as anthophyllite, may be employed to impart specific properties to the diaphragm. The present invention is particularly applicable to diaphragms containing high magnesia asbestos such as chrysotile and which are readily attacked by acidic electrolytes. Such diaphragms are usually made by slurrying the asbestos in aqueous solutions and drawing the slurry through a porous or perforated cathode member using a vacuum or pressure differential. This deposits the asbestos fibers on the cathode member to form a coating or mat thereon which may vary in thickness, for example, from $\frac{1}{8}$ inch to $\frac{1}{4}$ inch. In addition to asbestos, such diaphragms may contain other fibrous or polymeric materials.

Prior to treating the diaphragm with organic titanate, it is desirable to dry the diaphragm to remove moisture therefrom and thus avoid premature hydrolysis of the titanate compound. In actual practice, the diaphragm is usually attached to the cathode member, so that references herein to treatment of diaphragms includes such treatment of diaphragms, either alone or attached to the cathode member. The particular manner in which the newly drawn diaphragm is dried is not critical to the present invention. It is customary to dry such diaphragms in an oven at temperatures ranging from room temperature up to temperatures of about 120° C. Oven drying may also be combined with, or replaced by, air drying for extended periods of time.

The organic titanate employed must be one which readily hydrolyzes upon contact with water and which pyrolyzes to produce $TiO_2$. Titanium alkoxides (sometimes referred to as ortho alkyl titanates) are generally characterized by these properties and include the tetra alkyl titanates, the titanium chelates and titanium acylates. Ortho alkyl titanates wherein the alkyl group contains from 2 to 5 carbon atoms are preferred. The tetra alkyl titanates are particularly useful in the present invention. Tetraisopropyl titanate has been found to be the preferred compound, since it readily hydrolyzes upon contact with water and pyrolyzes at 350° C. to produce titanium dioxide containing pyrolysis products. These titanium alkoxides, and notably the tetra alkyl titanates, are available commercially. DuPont, for example, manufactures and sells such compounds under the trade name "TYZOR", with "TYZOR TPT" being tetraisopropyl titanate.

These organic titanates are dissolved in a solvent in order to thoroughly and uniformly distribute the titanate throughout the diaphragm. The solvent employed is one which avoids or minimizes hydrolysis of the titanate compound used, and which is capable of wetting the asbestos fibers in the diaphragm. It has been found that alcohols having the same alkyl group as that found in the titanate are particularly effective. For example, it is preferred to use anhydrous isopropanol as solvent for tetraisopropyl titanate.

The exact amount of organic titanate employed is not critical and may vary from about 2% to about 15% by weight of the solution. Expressed another way, the organic titanate in the solution is such as to deposit on the asbestos fibers in the diaphragm between 0.5% to 3% by weight of titanium expressed as titanium dioxide based on the weight of asbestos in the diaphragm. The lower limit is set by that amount of titanate necessary to provide the desired results of this invention (especially acid stability), while the upper limit is established by practical considerations of cost of the titanate and the permeability of the titanate containing diaphragm. As the amount of titanate in the diaphragm is increased, the permeability of the diaphragm decreases, which in turn reduces cell efficiency. Since no additional advantages are obtained using the larger amounts of titanate, it is preferred to use between 4% to 10% by weight titanate in the solution with the optimum amounts being about 4% to 5%. Expressed as titanium dioxide in the diaphragm, this calculates out to optimum percentages of about 1% to 1.5% titanium dioxide based on the weight of asbestos in the diaphragm.

In addition to the organic titanate, it has been found to be advantageous to use hydrochloric acid in the solution. The concentrated acid, which is preferred because of the low water content, contains 36% HCl, and is used to inhibit hydrolysis of the organic titanate. Also, the acid causes any hydrolyzed titanate to redissolve and thus clarify the solution. By avoiding premature hydrolysis of the titanate, more thorough and uniform contact of the titanate with the asbestos fibers is obtained. Small amounts of concentrated HCl, for example, 1% of the solution employed, are adequate to achieve these purposes. Although larger amounts of HCl may be employed, the sensitivity of the asbestos fibers (especially chrysotile) to acidic solutions, as well as the absence of any advantages resulting from such increased amounts of HCl, dictates the use of these smaller amounts of HCl. It will be apparent to anyone skilled in the art that the hydrochloric acid can be introduced in a more dilute form or even as a gas.

The asbestos diaphragm is immersed or soaked in titanate solution until the asbestos diaphragm or mat is thoroughly and uniformly impregnated with the solution. This may take up to five minutes, at which time the diaphragm may have absorbed as much as 80% to 95% of its weight of the solution. When the diaphragm is first immersed in the solution, bubbles are produced as the solvent displaces the air in the diaphragm. When the bubbles stop appearing, the impregnation of the diaphragm with the solution is complete. It will be apparent to one skilled in the art that other ways of impregnating the diaphragm with solution may be used, such as spraying the solution on the diaphragm until it is thoroughly soaked.

After the impregnation of the asbestos diaphragm with the titanate solution is complete, the excess solution is removed by draining, and the treated diaphragm then dried in an atmosphere containing an agent capable of hydrolyzing the titanate contained in the solution. Since water is the hydrolyzing agent customarily employed, the treated diaphragm may be dried in air containing sufficient water vapor to hydrolyze the titanate retained on the asbestos fibers of the diaphragm. Additional water vapor may be added to the air used to dry the diaphragm, and gases other than air, such as nitrogen, may be employed when desired. In the practice of the present invention, the titanate retained in the diaphragm is hydrolyzed prior to the pyrolysis step and this is preferably achieved during the drying step. This drying step may be carried out at room temperature for one hour, or at elevated temperatures, such as 75° C., for one hour or longer. The manner in which the treated diaphragm is dried is not critical as long as the excess titanate solution is removed and the titanate retained in the diaphragm is hydrolyzed.

The dried diaphragm containing hydrolyzed titanate is then heated at temperatures and for a time sufficient to pyrolyze the titanate in situ in the asbestos fibers of the diaphragm. In actual practice it is preferred to use temperatures somewhat above the pyrolysis temperature of the titanate employed, and to heat the diaphragm for a period sufficient to allow the pyrolysis of the titanate to be completed. For example, it is preferred to heat a diaphragm treated with tetraisopropyl titanate at temperatures of 400° C. to 425° C. for 15 minutes. Pyrolysis of this titanate occurs at 350° C., but diaphragms heated at 350° C. for 20 minutes were slightly grey, indicating that the pyrolysis was incomplete under these conditions. While longer heating times at lower temperatures may complete the pyrolysis of the titanate, the higher temperatures and shorter heating times are more practical from a commercial standpoint. Temperatures in excess of 550° C. should be avoided, however, since such temperatures will destroy the asbestos fibers.

The products produced by this pyrolysis step are believed to include titanium dioxide which may be in the form of a thin coating on the asbestos fibers. It is also possible that the titanate reacts with the asbestos during the pyrolysis step to assist in binding the fibers to one another. In any event, it has been found that this pyrolysis of the titanate causes the asbestos fibers to be firmly bonded to another to produce a more durable asbestos diaphragm. The practice of this invention produces a result which is both unexpected and unexplained, namely, the substantial increase in stability of asbestos fibers, such as chrysotile fibers, in acidic solutions. Whereas diaphragms made from chrysotile fibers will swell and disintegrate in highly acidic solutions in a matter of minutes, diaphragms comprising the present invention will remain intact in these same solutions for extended periods of time of one year or longer. Dimensional stability of the titanate treated diaphragms permits smaller amounts of asbestos to be used in the diaphragms, and this results in lower electrical resistance, which in turn reduces the energy needed to produce a given amount of product. As above noted, increased durability of the diaphragms comprising the present invention reduces down time for replacing diaphragm units. All of these factors reduce the cost of operating the electrolytic cells.

While this invention has been discussed primarily in relation to its use in the production of diaphragms for electrolytic cells, and particularly brine cells, it is also applicable to the production of porous, fibrous asbestos mats for a variety of uses where the improved properties of the treated mats above described are desired.

The following examples are included to illustrate the present invention, particularly as it applies to the use of this invention in electrolytic cells for the production of chlorine and caustic.

EXAMPLE 1

A. Test Cell

The cell used for tests herein set forth employed a circular anode, four inches in diameter, formed from a 1/16 inch thick titanium metal sheet coated with an oxide of ruthenium and titanium. The cathode used was a 4 inch diameter, circular wire mesh supported on a steel ring. A circular asbestos diaphragm, described in Part B of this example, is placed against the cathode and a glass spacing ring contacts the periphery of the diaphragm to hold it in place against the cathode. The anode is positioned within the glass spacing ring to provide a gap between the anode surface and the cathode surface of approximately ¼ inch. A hollow steel member in pressure contact with the back of the cathode forms a catholyte compartment, and this entire assembly is held in liquid tight relationship through use of suitable clamps and gaskets. A source of direct current is attached to the anode and cathode, respectively, and the entire cell placed in a glassed-in cabinet and maintained at 80° C.

In operation, brine containing 270 grams per liter of NaCl acidified with HCl to a pH of 2 is fed into the anolyte chamber through the glass spacing ring. The ring also has an outlet for the chlorine gas formed during operation of the cell. The head pressure of the brine is adjustable from 4 inches to 20 inches and is varied during operation to maintain NaOH concentration in the catholyte of about 100 grams per liter. The cell is operated at a current density of 0.5 amps per square inch which generally requires a voltage of 2.7 to 2.9 volts, depending upon the diaphragm used. Openings are provided in the hollow steel member which forms the catholyte chamber for removal of hydrogen gas and cell effluent containing NaOH produced during the operation of the cell. Flow rate through the cell is between about 1 to about 2 milliliters per minute.

B. Asbestos Diaphragm

Six grams of No. 1 long chrysotile fibers and 10 grams of No. 2 short chrysotile fibers are added to 2 liters of aqueous, chlorine/caustic cell effluent containing about 100 grams per liter of NaOH and about 150 grams per liter of NaCl. As used herein "No. 1 long" and "No. 2 short" chrysotile fibers are defined as follows: "No. 1 long" are chrysotile fibers of a length such that about 90% is retained on a 10 mesh screen, and "No. 2 short" are chrysotile fibers of a length such that about 30% are retained on a 10 mesh screen. The asbestos is stirred by sparging air through the mixture for 15 minutes to produce a uniform slurry. The slurry is then poured into a Buchner funnel and a vacuum pulled on the funnel to draw the asbestos fibers onto the filtering face of the funnel and to remove the cell effluent liquor. The mat or diaphragm formed on the filtering face is then washed with two liters of distilled water, and the washed diaphragm removed and placed in a drying oven at 100° C. for 2 hours. The dry weight of the diaphragm is approximately 16 grams and the diameter about 4 inches.

EXAMPLE 2

Three asbestos diaphragms were prepared as described in Example 1B, except that the diaphragms were six inches in diameter and contained 12 grams of No. 1 long chrysotile fibers and 24 grams of No. 2 short chrysotile fibers. Diaphragm No. 1 was heated at 425° C. for 20 minutes. Diaphragm No. 2 was impregnated with a solution containing 4 grams tetraisopropyl titanate (TPT), 1 gram of 36% HCl, and 95 grams of isopropanol, the excess solution removed by draining and the diaphragm then heated at 425° C. for 20 minutes. Diaphragm No. 3 was treated in the same manner as No. 2 except that the treating solution contained 5 grams of tetraisopropyl titanate in place of the 4 grams used with diaphragm No. 2. Each diaphragm was cut in half and one half put in a glass jar filled with an aqueous 2 normal NaOH solution. The following results were obtained:

| Diaphragm No. | 15 Hours at Room T° | Plus | 20 Hours at 85° C. | Plus | 4½ Days at 85° C. |
|---|---|---|---|---|---|
| 1 (untreated) | swollen | | very soft | | badly swollen and soft |
| 2 4% titanate | no change | | semi-rigid | | semi-rigid |
| 3 5% titanate | no change | | most rigid | | most rigid |

EXAMPLE 3

Four asbestos diaphragms were prepared as described in Example 1B except that the diaphragms were 6 inches in diameter and contained 8.4 grams of No. 1 long chrysotile fibers and 16.8 grams of No. 2 short chrysotile fibers. These diaphragms were treated as follows:

Diaphragm No. 1 was untreated except that it was heated at 425° C. for 20 minutes.

Diaphragm No. 2 was immersed in a solution containing 5 grams of tetraisopropyl titanate, 1 gram of 36% HCl and 94 grams of isopropanol, the excess solution drained and the diaphragm then heated at 425° C. for 20 minutes.

Diaphragm No. 3 was treated in the same manner as Diaphragm No. 2 with the single exception that the HCl was omitted from the solution.

Diaphragm No. 4 was treated in the same manner as Diaphragm No. 2 except that treating solution contained 5 grams of tetraisopropyl titanate and 159 grams of 1,1,1-trichloroethane.

Each diaphragm was cut into 3 pieces. One piece was sent for analysis. One piece of each diaphragm was immersed in distilled water for several days. Diaphragm No. 1 softened slightly, but the others were unchanged. The third piece of each diaphragm was immersed in 1 normal HCl solution at a temperature of 70° C. with the following results:

| Diaphragm No. | After 2 Minutes | After 3 Days | After 4 Weeks |
|---|---|---|---|
| 1 (untreated) | disintegrated | — | — |
| 2 (titante, HCl isopropanol) | no change | no change | no change |
| 3 (titanate, isopropanol) | no change | no change | no change |
| 4 (titanate, 1,1,1-trichloroethane) | no change | no change | no change |

EXAMPLE 4

Three diaphragms were prepared as described in Example 1B except that they were 6 inches in diameter and contained chrysolite fibers as described in Example 2. These three diaphragms were dried at 120° C. and then two of the diaphragms were immersed in isopropanol solutions containing 5% and 10% by weight, respectively, of tetraisopropyl titanate (TPT). The treated diaphragms were dried at 120° C. for 1 hour and then heated at 425° C. for 10 minutes. Each diaphragm was supported on a screen and clamped in a water-tight arrangement between two plastic pipes having 4.81 inch internal diameters. Flow rates through each diaphragm in milliliters per minute were measured using a water head of 8.5 inches, with the following results:

| Untreated Diaphragm | | Diaphragm with 5% TPT | | Diaphragm with 10% TPT | |
|---|---|---|---|---|---|
| Minutes | M1/Min | Minutes | M1/Min | Minutes | M1/Min |
| 60 | 2.83 | 60 | 3.17 | 60 | 2.20 |
| 120 | 3.20 | 120 | 2.58 | 141 | 2.10 |
| 192 | 3.13 | 191 | 2.46 | 207 | 1.97 |
| 259 | 3.33 | 257 | 2.62 | 302 | 1.93 |
| 331 | 3.19 | 328 | 2.46 | 409 | 1.91 |

It is evident from these data that treatment with the 5% TPT solution reduces the permeability of the diaphragm somewhat and that treatment with a 10% TPT solution produces a marked reduction in permeability.

EXAMPLE 5

Six diaphragms were prepared as described in Example 1B, using the same ratio of No. 1 and No. 2 chrysotile fibers but varying the total weight of fibers in the diaphragms. One diaphragm was untreated. The other five of these diaphragms were immersed for 5 minutes in a solution containing 1% of 36% HCl, 5% tetraisopropyl titanate and 94% isopropanol. All of the diaphragms were then drained, dried at 100° C. for 2 hours, followed by heating at 425° C. for 20 minutes. The five treated diaphragms, along with the untreated diaphragm, were mounted in laboratory cells constructed and operated as described in Example 1A. In the results shown below, the NaOH efficiency is measured at 100 grams per liter NaOH:

| Asbestos Weight in diaphragm | Cell Voltage | gm/1 NaOH in Catholyte | % NaOH Efficiency |
|---|---|---|---|
| 16 grams (untreated) | 2.88 | 100 | 95.6 |
| 13.4 grams | 2.82 | 98 | 95.8 |
| 12.8 grams | 2.81 | 106 | 95.2 |
| 11.4 grams | 2.75 | 104 | 92.0 |
| 10.7 grams | 2.72 | 107 | 92.5 |
| 9.6 grams | 2.71 | 103 | 90.0 |

NaOH efficiency is calculated by comparing actual weight of NaOH produced with the theoretical amount possible under cell conditions. The lightest (and thinnest) diaphragms showed decreased NaOH efficiency as expected, due to migration of NaOH back through the diaphragm into the anolyte compartment. Those diaphragms weighing 13.4 grams and 12.8 grams, however, showed no significant change in NaOH efficiency. Thus, treated diaphragms weighing as little as 70% as the standard untreated diaphragm appear to maintain adequate separation of the catholyte and anolyte compartments.

EXAMPLE 6

Five diaphragms were prepared as described in Example 1B, but using varying amounts of asbestos as described in Example 5. One of these diaphraams was treated with the titanate solution and according to the procedures described in Example 5. The other four diaphragms were treated in like manner with the exception that 4% tetraisopropyl titanate (TPT) was used rather then 5% as in Example 5. These diaphragms were then mounted in electrolytic cells constructed and operated as described in Example 1A. In the results shown in the following table NaOH efficiency is measured at 100 grams per liter NaOH:

| Asbestos Weight | % TPT | % $TiO_2$ Based on Asbestos | Volts | % NaOH Efficiency |
|---|---|---|---|---|
| 13.4 grams | 4 | 1.0 | 2.81 | 95.8 |
| 12.7 grams | 4 | 1.2 | 2.81 | — |
| 11.8 grams | 4 | 1.3 | 2.76 | — |
| 10.8 grams | 4 | 1.4 | 2.76 | 93.3 |
| 10.8 grams | 5 | 1.7 | 2.76 | 96.4 |

EXAMPLE 7

In order to determine the effect of various pyrolysis temperatures upon stability of the treated diaphragms in caustic, eight six-inch diaphragms were prepared as described in Example 2. Diaphragms numbered 1 through 6 were treated with the titanate solution as described in Example 2 (1% HCl, 4% TPT, 95% isopropanol). The heating or pyrolysis temperature, however, was varied from 300° C. to 425° C. Diaphragms numbered 7 and 8 were not treated with the titanate solution and are, therefore, designated "untreated" in the following table. These latter two diaphragms were heated at 425° C. and 500° C., respectively, for the same time (20 minutes) as diaphragms 1 through 6. Each diaphragm half was then placed in a jar filled with 2 normal NaOH and examined after varying periods of time. Results are tabulated as follows:

| Diaphragm Number | Pyrolysis Temperature | After Pyrolysis | Appearance After 15 hours at room temperature + 20 hours at 85° C. | After 5 months in 2 normal NaOH |
|---|---|---|---|---|
| 1 | 300° C. | Blackish | Considerably softened | Very swollen and soft |
| 2 | 325° C. | Blackish | Considerably softened | Somewhat swollen, semi-rigid |
| 3 | 350° C. | Grey | Considerbly softened | |
| Somewhat swollen, | | | | semi-rigid |

-continued

| Diaphragm Number | Pyrolysis Temperature | After Pyrolysis | Appearance After 15 hours at room temperature + 20 hours at 85° C. | After 5 months in 2 normal NaOH |
|---|---|---|---|---|
| 4 | 375° C. | White | Considerably softened | Somewhat swollen, semi-rigid |
| 5 | 400° C. | White | semi-rigid | Very slightly swollen, semi-rigid |
| 6 | 425° C. | White | Semi-rigid | Very slightly swollen, semi-rigid |
| 7 (untreated) | 425° C. | White | Very soft, swollen | Disintegrated (original shape no longer recognizable) |
| 8 (untreated) | 500° C. | White | Very soft, swollen | Disintegrated (original shape no longer recognizable) |

EXAMPLE 8

In order to compare diaphragms having an organic titanate hydrolyzed therein in situ with those having the hydrolyzed organic titanate pyrolyzed in situ, two 6-inch diameter diaphragms prepared as described in Example 3 were immersed in a solution comprising 5% tetraisopropyl titanate, 1% concentrated HCl and 94% isopropanol. After immersion for 5 minutes, the two diaphragms were air dried at room temperature for about 2½ days. One diaphragm (designated "Hydrolyzed") received no further treatment. The other diaphragm was heated at 425° C. for 20 minutes. Both diaphragms were approximately 3 millimeters thick. Each diaphragm was cut into several pieces about 1 inch by 2 inches and these pieces then placed in glass jars containing water, 1 normal HCl and 1 normal NaOH, with the following results:

| Jar Contents | Hydrolyzed Diaphragm | Pyrolyzed Diaphragm |
|---|---|---|
| Water | swollen to ~6 mm in 1 hour | no effect after 24 hours, rigid |
| 1 normal HCl | disintegrated in 5 minutes | no effect after 24 hours, rigid |
| 1 normal NaOH | swollen to ~6 mm in 1 hour | no effect after 24 hours, rigid |

What is claimed is:

1. A. porous, fibrous asbestos-containing mat characterized by having the asbestos fibers bonded to one another by the pyrolysis products of a hydrolyzed organic titanate.

2. The mat of claim 1 wherein at least some of the asbestos fibers are chrysotile and the organic titanate is an ortho alkyl titanate.

3. The mat of claim 2 wherein the ortho alkyl titanate is a tetra alkyl titanate in which the alkyl group contains from 2 to 5 carbon atoms and is present in an amount such that said pyrolysis products constitute from 0.5 to 3% by weight of the asbestos fibers.

4. The mat of claim 1 wherein said mat is a diaphragm for use in an electrolytic cell.

5. A porous asbestos-containing diaphragm composed at least in part of fibrous chrysotile and intended for use in an electrolytic cell for the production of chlorine and caustic, said diaphragm being characterized by having the asbestos fibers bonded to one another by the pyrolysis products of a hydrolyzed ortho alkyl titanate, said pyrolysis products being present in an amount such as to provide from 0.5 to 3.0% by weight of titanium expressed as titanium dioxide.

6. The diaphragm of claim 5 wherein the alkyl group of the ortho alkyl titanate contains from 2 to 5 carbon atoms.

7. The diaphragm of claim 6 wherein the weight of titanium present expressed as titanium dioxide is between 1% and 2%.

8. The diaphragm of claim 7 wherein the ortho alkyl titanate is a tetra alkyl titanate.

9. The diaphragm of claim 8 wherein the tetraalkyl titanate is tetraisopropyl titanate.

10. The diaphragm of claim 8 wherein the tetraalkyl titanate is tetrabutyl titanate.

11. In a porous diaphragm composed essentially of asbestos fibers, at least some of which are chrysotile and which is deposited from an aqueous slurry upon a porous metal cathode member for use in an electrolytic cell, the improvement which comprises impregnating the diaphragm with a solution containing an organic titanate, drying the impregnated diaphragm in the presence of a hydrolyzing agent to hydrolyze the titanate in situ, and pyrolyzing the hydrolyzed titanate.

12. The diaphragm of claim 11 in which the electrolytic cell produces caustic and halogen and the organic titanate is an ortho alkyl titanate.

13. The diaphragm of claim 12 in which the ortho alkyl titanate is a tetra alkyl titanate in which the alkyl groups each contain from 2 to 5 carbon atoms.

14. The diaphragm of claim 13 in which solution contains from 2% to 15% by weight of tetra alkyl titanate and the balance is essentially a solvent that does not hydrolyze the titanate and which readily wets the asbestos fibers.

15. The diaphragm of claim 14 in which the tetra alkyl titanate is tetraisopropyl titanate.

16. The diaphragm of claim 15 in which the tetraisopropyl titanate is present in the solution in amounts between about 4% to about 10% by weight.

17. The diaphragm of claim 15 in which the solution contains sufficient hydrochloric acid to redissolve any hydrolyzed titanate formed during the preparation of the solution and in which the solvent is isopropanol.

18. In an electrolytic cell for producing chlorine and caustic and containing an anode, a cathode and a porous asbestos diaphragm positioned between the anode and the cathode, the improvement which comprises impregnating the diaphragm with a solution containing an ortho alkyl titanate, hydrolyzing the titanate in situ, and pyrolyzing the hydrolyzed titanate.

19. The electrolytic cell of claim 18 wherein at least some of the asbestos in the diaphragm is fibrous chrysotile and the ortho alkyl titanate is a tetra alkyl titanate wherein the alkyl group contains from 2 to 5 carbon atoms.

20. The electrolytic cell of claim 19 wherein the solution contains sufficient titanate to provide from 1 to 2% titanium in the hydrolyzed titanate calculated as titanium dioxide.

21. A method of treating a fibrous asbestos-containing mat which comprises bonding the asbestos fibers to one another by pyrolyzing in situ in the mat a hydrolyzed organic titanate.

22. The method of claim 21 wherein the mat is a diaphragm for use in an electrolytic cell and the organic titanate is an ortho alkyl titanate.

23. The method of claim 22 wherein the electrolytic cell is one for the production of chlorine and caustic and the ortho alkyl titanate is a tetra alkyl titanate in which each alkyl group contains from 2 to 5 carbon atoms.

24. In a method of making a porous, fibrous asbestos-containing diaphragm for use in an electrolytic cell in which the asbestos fibers are deposited from an aqueous slurry onto a porous metal cathode, the improvement which comprises impregnating the diaphragm with a solution containing a solvent and an organic titanate, drying the impregnated diaphragm in the presence of a hydrolyzing agent for the titanate, and pyrolyzing the hydrolyzed titanate.

25. The method of claim 24 in wich at least some of the asbestos fibers are chrysotile and the organic titanate is an ortho alkyl titanate in which each of the alkyl groups contain from 2 to 5 carbon atoms.

26. The method of claim 25 wherein the solution contains sufficient ortho alkyl titanate such that, upon pyrolysis from 0.5 to 3% by weight of titanium expressed as titanium dioxide remains in the diaphragm.

27. The method of claim 25 wherein the ortho alkyl titanate is a tetra alkyl titanate and the solution contains from 4% to 10% by weight of the tetra alkyl titanate.

28. The method of claim 27 wherein the solution contains sufficient hydrochloric acid to redissolve any hydrolyzed titanate that may form during preparation of the solution, and solvent is an alcohol containing the same alkyl group as the tetra alkyl titanate.

29. The method of claim 27 wherein the tetra alkyl titanate is tetraisopropyl titanate.

30. The method of claim 29 wherein the tetraisopropyl titanate constitutes 4% to 5% by weight of the solution and the solvent is isopropanol.

* * * * *

UNITED STATES PATENT AND TRADEMARK OFFICE

CERTIFICATE OF CORRECTION

PATENT NO. : 4,180,449

DATED : December 25, 1979

INVENTOR(S) : Henrik R. Heikel

It is certified that error appears in the above-identified patent and that said Letters Patent are hereby corrected as shown below:

Col. 6, in the Table of Example 3, second item in the first column, delete the word "titante" and insert --titanate--.

Columns 7 and 8, in the Table of Example 7, item No. 3 in the 4th column, delete the word "Considerbly" and insert --Considerably-- and also move the words "Somewhat swollen," which are now under Col. 1, to Col. 5, just above the words "semi-rigid".

Col. 12, Claim 25, line 1, delete the word "wich" and insert --which--.

Signed and Sealed this

*Thirteenth* Day of *May 1980*

[SEAL]

*Attest:*

SIDNEY A. DIAMOND

*Attesting Officer*

*Commissioner of Patents and Trademarks*